US011994126B2

(12) United States Patent
Mlsna et al.

(10) Patent No.: US 11,994,126 B2
(45) Date of Patent: May 28, 2024

(54) METHODS AND SYSTEMS FOR LUBRICATING A TRANSPORT CLIMATE CONTROL SYSTEM HAVING AN AUXILIARY SUMP

(71) Applicant: THERMO KING LLC, Minneapolis, MN (US)

(72) Inventors: Eric S. Mlsna, Cashton, WI (US); Lars I. Sjoholm, Burnsville, MN (US)

(73) Assignee: THERMO KING LLC, Minneapolis, MN (US)

( * ) Notice: Subject to any disclaimer, the term of this patent is extended or adjusted under 35 U.S.C. 154(b) by 0 days.

(21) Appl. No.: 17/688,430

(22) Filed: Mar. 7, 2022

(65) Prior Publication Data

US 2023/0279860 A1 Sep. 7, 2023

(51) Int. Cl.
*F04C 18/02* (2006.01)
*F04C 29/02* (2006.01)

(52) U.S. Cl.
CPC ..... *F04C 18/0215* (2013.01); *F04C 29/025* (2013.01); *F04C 2240/30* (2013.01); *F04C 2240/809* (2013.01)

(58) Field of Classification Search
CPC ..... F04C 29/025; F04C 18/0215; F04C 2240/30; F04C 2240/809
See application file for complete search history.

(56) References Cited

U.S. PATENT DOCUMENTS 8,408,024 B2 * 4/2013 Ogata ..... F04C 18/0215 62/468
8,944,790 B2 * 2/2015 Ma ..... F04C 18/0215 418/94
10,288,068 B2 * 5/2019 Ge ..... F04C 29/0085

FOREIGN PATENT DOCUMENTS

| | | |
|---|---|---|
| CN | 202431485 | 9/2012 |
| CN | 203926007 | 11/2014 |
| EP | 0543756 | 5/1993 |
| EP | 2177760 | 4/2010 |
| EP | 2202384 | 6/2010 |

(Continued)

OTHER PUBLICATIONS

Machine Translation and Foreign Patent Publication for JP H 07-229495; Inventor: Sachio; Title: Horizontal Rotary Compressor; Published: Aug. 29, 1995. (Year: 1995).*

(Continued)

*Primary Examiner* — Mary Davis
(74) *Attorney, Agent, or Firm* — HSML P.C.

(57) ABSTRACT

A climate control system includes a compressor which includes a compressor housing, a compressor element provided in the compressor housing, a lubricant circuit, and an auxiliary sump. The lubricant circuit includes a lubricant sump provided in the compressor housing. The auxiliary sump is in fluid communication with the lubricant sump. A method for maintaining lubrication supply for a compressor of a climate control system includes transferring lubricant from the auxiliary sump to the lubricant sump of the compressor when a height of the lubricant in the auxiliary sump is greater than a height in the lubricant sump and returning the lubricant from the lubricant sump to the auxiliary sump when a height of the lubricant in the lubricant sump is higher than a height of a predetermined minimum level in the lubricant sump. The lubricant in the auxiliary sump and lubricant sump are equalized by gravity.

14 Claims, 6 Drawing Sheets

(56) References Cited

FOREIGN PATENT DOCUMENTS

| | | |
|---|---|---|
| JP | 07-229495 | 8/1995 |
| JP | 4031683 | 1/2008 |
| WO | 2015/168101 | 11/2015 |
| WO | 2017/063480 | 4/2017 |

OTHER PUBLICATIONS

Extended European Search Report, issued in the corresponding European patent application No. 23159524.0, dated Oct. 2, 2023, 8 pages.

* cited by examiner

METHODS AND SYSTEMS FOR LUBRICATING A TRANSPORT CLIMATE CONTROL SYSTEM HAVING AN AUXILIARY SUMP

FIELD

This disclosure generally relates to a climate control system. More specifically, this disclosure relates to a heating, ventilation, air conditioning, and refrigeration (HVACR) system having a compressor with a lubricant sump for lubricating moving parts of the compressor.

BACKGROUND

A heating, ventilation, air conditioning, and refrigeration (HVACR) system generally includes a compressor, such as a scroll compressor, rotary compressor, centrifugal compressor, reciprocating compressor, or other suitable type of compressor for compressing a working fluid. Such compressors, for example, scroll compressors, include a number of moving parts, for example, a pair of scroll members which orbit relative to each other to compress a working fluid, such as, for example, a refrigerant, and bearings for supporting the moving parts. The moving parts, including the bearings, generally include a lubrication system for proper lubrication, since if the moving parts and/or bearings are not properly lubricated, the compressor may fail prior to an expected lifetime of the compressor parts.

SUMMARY

This disclosure relates generally to a heating, ventilation, air conditioning, and refrigeration (HVACR) system. More specifically, this disclosure relates to providing lubrication to a compressor in a heating, ventilation, air conditioning, and refrigeration (HVACR) system.

In an embodiment, an HVACR system includes a positive displacement compressor, such as, for example, a rotary compressor or reciprocating compressor. In an embodiment, the positive displacement compressor is a variable speed compressor.

In an embodiment, the variable speed compressor is a variable speed vertical scroll compressor. In an embodiment, the variable speed vertical scroll compressor can be operated between a minimum and a maximum speed for compressing a selected working fluid (e.g., refrigerant), in which lubricant is provided in a lubricant sump below the compressor elements, e.g., orbiting scroll and fixed scroll.

In an embodiment, the selected working fluid includes a refrigerant, such as R-134a, or a refrigerant having a relatively lower global warming potential (GWP) than R-134a and that may be utilized as a replacement refrigerant for R-134a. In an embodiment, the selected refrigerant can be R1234ze(E), R-513A, or the like.

In an embodiment, the HVACR system includes a lubricant separator. The lubricant separator can incorporate a lubricant tank. In an embodiment, combining the lubricant separator and the lubricant tank may reduce an overall complexity of the HVACR system.

A climate control system for the HVACR system is disclosed. In an embodiment, the climate control system includes a compressor, a lubricant circuit, and an auxiliary sump. The compressor includes a compressor housing and a compressor element provided in the compressor housing for compressing a working fluid. The lubricant circuit includes a lubricant sump provided in the compressor housing for storing a lubricant, in which the lubricant is provided for lubricating moving parts of the compressor. The auxiliary sump is provided in fluid communication with the lubricant sump, in which the auxiliary sump is provided such that the lubricant flows by gravity between the auxiliary sump and the lubricant sump. In an embodiment, the climate control system is a transport climate control system.

A method for maintaining lubrication supply for a compressor of a climate control system is also disclosed. The method includes transferring lubricant from the auxiliary sump to the lubricant sump of the compressor when a height of the lubricant in the auxiliary sump is greater than a height of the lubricant in the lubricant sump. The method also includes returning the lubricant from the lubricant sump to the auxiliary sump when the height of the lubricant in the lubricant sump is higher than a height of a predetermined minimum level in the lubricant sump. The lubricant in the auxiliary sump and lubricant sump are equalized by gravity.

A lubricant circuit for a compressor of a climate control system is also disclosed. The lubricant circuit includes a lubricant sump and an auxiliary sump. The lubricant sump is provided in a compressor housing for storing a lubricant, in which the lubricant is provided for lubricating moving parts of the compressor. The auxiliary sump is provided in fluid communication with the lubricant sump, in which the auxiliary sump is configured in a way such that the lubricant flows by gravity between the lubricant sump and the auxiliary sump.

BRIEF DESCRIPTION OF THE DRAWINGS

References are made to the accompanying drawings that form a part of this disclosure, and which illustrate embodiments in which the systems and methods described in this Specification can be practiced.

Like reference numbers represent like parts throughout.

DETAILED DESCRIPTION

Figure 1:
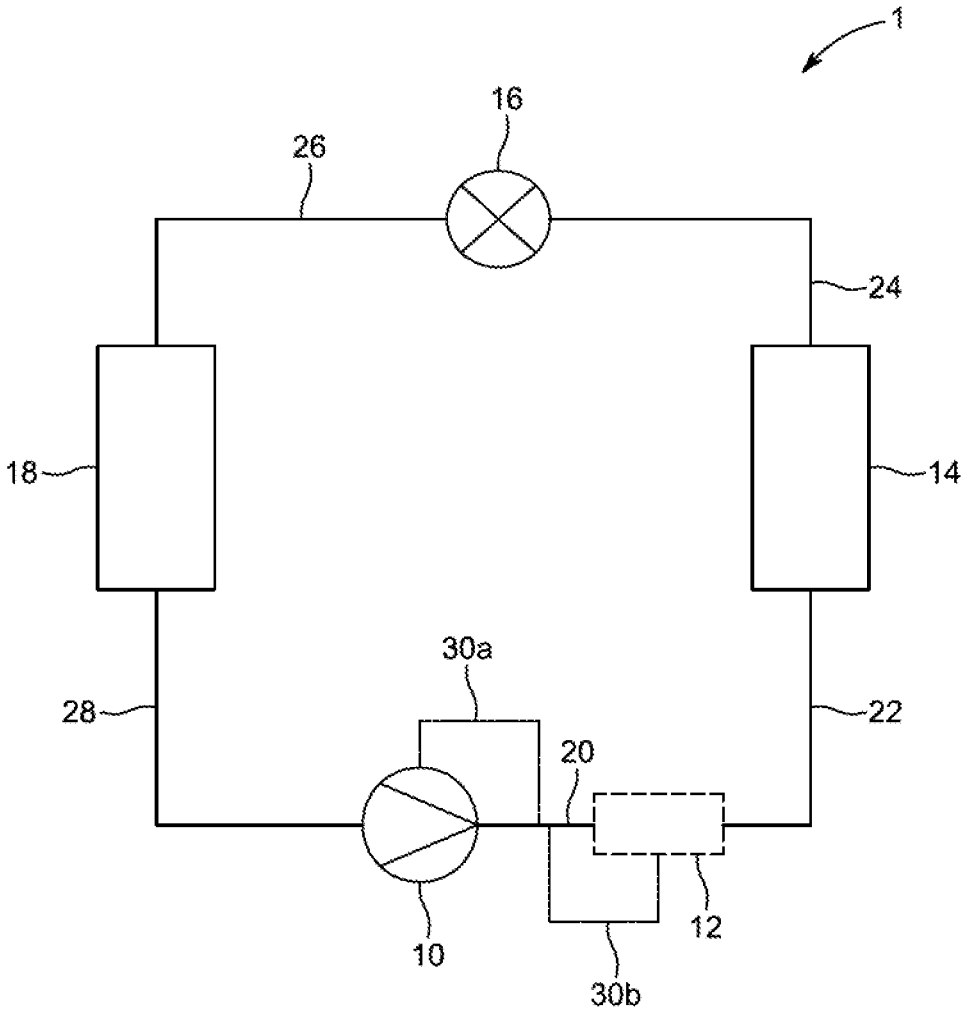
FIG. 1 is a schematic diagram of a climate control circuit, according to an embodiment.

This disclosure generally relates to a positive displacement compressor, and preferably to a scroll compressor. More specifically, this disclosure relates to providing lubrication to a scroll compressor in a climate control system for a heating, ventilation, air conditioning, and refrigeration (HVACR) system.

Lubricant flow inside a compressor is a complex process. For example, in a vertical scroll compressor, a lubricant sump is provided at a lower portion of the compressor housing, in which the lubricant sump has a defined level to provide a certain amount of lubricant to the compressor. The availability of the lubricant for lubricating the various parts of the scroll compressor, however, can vary depending on different operating conditions. For example, during start-up conditions of the scroll compressor, the moving parts of the compressor, e.g., orbiting scroll, counter weights, or the like, and/or the bearings, e.g., upper bearings, lower bearings, orbiting bearings, thrust bearings, or the like, are initially primed for lubrication. The majority of the lubricant is returned from the moving parts to the lubricant sump after overcoming certain forces, for example, gravity, surface tension, or the like, which is dependent on a number of factors including lubricant viscosity, temperature, amount of working fluid entrained in the lubricant, shape of the moving parts, or the like. Thus, the amount of lubricant available in the lubricant sump can vary as the lubricant drains down the scroll compressor during start-up operation until an equilibrium level of the flow of lubricant in the compressor is established.

It is also appreciated that the draining of the lubricant down the scroll compressor can change depending on a number of factors, such as, lubricant viscosity, amount of working fluid in the lubricant, speed of the compressor, or the like. Thus, the amount of lubricant available in the lubricant sump due to gravity drain can also vary depending on various operating conditions, or changes thereof, of the scroll compressor.

Further, the amount of lubricant available in the lubricant sump can vary during operation of the scroll compressor due to entrainment of the lubricant. For example, during compression operation, the lubricant can be entrained with the compressed working fluid and exit the scroll compressor with the working fluid. The lubricant can then be returned with the working fluid at the suction of the scroll compressor and/or via a lubricant separator and/or during lubricant removal at the expander and/or the evaporator. Thus, the amount of lubricant in the lubricant sump can further vary until an equilibrium of the flow of lubricant exiting the scroll compressor equals the amount of lubricant returned to the scroll compressor from the various processes of the climate control cycle of the working fluid, e.g., because the lubricant is trapped on the discharge side of the compressor, e.g., saturated, especially, for high speed compressors. It is also appreciated that since the lubricant is subjected to the working cycle of the climate control circuit, the lubricant being returned from the climate control cycle can have an increased temperature and may need to be processed, e.g., removal of the working fluid and/or cooled or heated, before being returned to the lubricant sump.

While the lubricant sump is designed to store the amount of lubricant necessary for the operation of the scroll compressor, e.g., a volume dependent on single temperature or multi-temperature systems or multiple evaporator systems, the level of the lubricant in the lubricant sump is generally controlled to be lower than the lowest part of the drive shaft, e.g., the lower counter weights, at least because the efficiency and/or performance of the compressor can be affected when the lubricant is in contact with certain compressor parts. Thus, in prior designed scroll compressors, only a fixed amount of lubricant is available for lubricating the moving parts and/or the bearings of the compressor.

However, as discussed above, during various operations (or change of operations) of the scroll compressor, the amount of lubricant available in the lubricant sump can vary and, in some instances, the lubricant sump can be emptied, in which additional lubricant is not available for lubrication of the moving parts of the compressor, which can result in damage to the scroll compressor. For example, during a change of low speed to high speed operation of the scroll compressor, a large amount of lubricant can be initially pumped from the lubricant sump to the moving parts which empties the lubricant sump until an equilibrium of the flow of lubricant is established, e.g., the lubricant is not available until the amount of lubricant draining down the scroll compressor equals the amount of lubricant pumped to the scroll compressor. Additionally, the lubricant sump can be emptied during repeated start and stop operation of the scroll compressor, in which the lubricant can be entrained with the compressed working fluid or supplied/pumped to the moving parts of the compressor, until the lubricant is returned to the lubricant sump.

In order to avoid dry operation of the lubricant sump, different structures can be used in order to ensure lubricant availability in the lubricant sump to avoid damage to the compressor components due to inadequate lubrication. For example, the size of the lubricant sump can be increased. However, for certain applications of the scroll compressor, for example, compressors used for transport climate control systems for a transport unit, the space available for a larger lubricant sump in the existing footprint/design of the engine and/or transport climate control system is limited, in which neither the diameter nor the height of the scroll compressor can be increased due to the compactness of the engine and/or climate control system of the transport unit. For example, since a vertical screw compressor already has a high height due to the vertical arrangement of the compressor parts, increasing the height of the lubricant sump, and thus, increasing the height of the vertical screw compressor, is not an optimal solution. Moreover, since the manufacturing and design of the scroll compressor housing and/or casing and/or the engine and/or the climate control system is expensive, the modification of such designs, e.g., to accommodate the increase in the height and/or diameter of the lubricant sump, is not a cost effective solution. For example, not only would such redesign require engineered re-arrangement of the different components, an alignment of the compressor parts may be needed due to the sizing changes of the compressor.

Furthermore, while some prior designs of lubricant control use limits on the level of lubricant available in the evaporator to control the available amount of lubricant in the compressor, such advanced designs are complicated and typically lead to inefficiencies of the compressor, e.g., increase in temperature, compressor inefficiency, lower reliability, and can require additional capital investment to modify the control and design of the climate control circuit of the climate control system. For example, the temperature of the lubricant in the evaporator may need to be decreased and/or any entrained working fluid in the lubricant may need to be removed before being returned to the lubricant sump. Such design not only requires additional capital costs, but also requires additional equipment which is not optimal in space-limited applications, e.g., for a transport unit.

In order to overcome the deficiencies of the prior designs of the scroll compressor, in an embodiment, an auxiliary sump that is fluidly connected to the lubricant sump of the scroll compressor can be provided to provide a buffering/auxiliary capacity of lubricant to the scroll compressor, as further discussed below. For example, during changes of operating modes, e.g., starting and stopping of a compressor, the lubricant can be pumped quickly from the lubricant sump to lubricate the moving parts of the compressor. By using an auxiliary sump, the auxiliary sump provides a buffer system that can transfer lubricant to the compressor, to avoid damage to compressor due to inadequate lubrication, which can avoid the lubricant sump from being emptied. The auxiliary sump also provides buffering capacity during startup conditions of the compressor, when the compressor is run at higher speeds to pull down temperature for a conditioned space, as fast as possible, which pumps/uses more lubricant than used during normal operations of the compressor.

It is appreciated that since the auxiliary sump is not provided in the compressor housing, in an embodiment, such design allows the use of existing scroll compressors for multiple applications, e.g., single temperature or multi-temperature applications and/or systems, in which the size of the auxiliary sump can be adjusted depending on the application. For example, for a high speed application of a scroll compressor, e.g., a scroll compressor that runs at a speed between 6500 and 7500 RPM, and preferably around 7200 RPM, a larger auxiliary sump can be provided, since a greater amount of lubricant is necessary than, for example, a low speed application of the same or similar scroll compressor, having a speed of between 500-1500 RPM, and preferably around 900 RPM, since more lubricant is pumped to the moving parts of the compressor and/or entrained with the working fluid.

Such design also allows the use a plurality of smaller compressors in place of a larger compressor, in which the smaller compressors do not have a sufficient supply of lubricant for high-speed (or over-speed) applications. The auxiliary sump, however, provides a buffering amount of lubricant supply necessary when using a plurality of smaller compressors, in which a single auxiliary sump can be used to supply lubricant to the plurality of smaller compressors, or a plurality of auxiliary sumps are provided to supply the buffering amount of lubricant.

Such a design also allows the use of a single compressor in different applications. For example, in an embodiment in which a multi temp system and a single temp system is used, one compressor can be used that is common to both the multi temp system and the single temp system, in which the auxiliary sump is only provided to the compressors that require the additional supply of lubricant, e.g., the compressors used in the multi temp system that require more lubricant volume.

FIG. 1 is a schematic diagram of a climate control circuit, according to an embodiment. The climate control circuit 1 generally includes a compressor 10, a condenser 14, an expander 16, and an evaporator 18.

The climate control circuit of FIG. 1 is an example and can be modified to include additional components. For example, in an embodiment, the climate control circuit can include other components such as, but and not limited to, one or more flow control devices, economizers, receiver tanks, dryers, suction-liquid heat exchangers, lubricant separators, lubricant heaters, lubricant coolers, filters, or the like. In an embodiment, the climate control circuit can be configured to be a cooling system (e.g., an air conditioning system) capable of operating in a cooling mode. In an embodiment, the climate control circuit can be configured to be a heat pump system that can operate in both a cooling mode and a heating/defrost mode.

The climate control circuit can be applied in a variety of systems used to control one or more environmental conditions (e.g., temperature, humidity, air quality, or the like) in a space (generally referred to as a conditioned space). Examples of such systems include, but are not limited to, HVACR systems, transport refrigeration systems, or the like. Examples of a conditioned space include, but and not limited to, a portion of a home, building, an environmentally controlled container on a vehicle, such as, a box car, a semi-tractor, a bus, ship, or vessel, or other similar transport unit. The climate control circuit can be used for a single temperature application or for a multi-temperature application, e.g., multiple climate control zones, for a transport unit.

As shown in in FIG. 1, the climate control circuit includes the compressor 10, the condenser 14, the expander 16, and the evaporator 18, which are fluidly connected via working fluid lines 22, 24, 26, and 28. In an embodiment, the working fluid lines 22, 24, 26, and 28 can alternatively be referred to as the working fluid conduits 22, 24, 26, and 28.

In operation, the compressor 10 compresses a working fluid (e.g., a heat transfer fluid such as a refrigerant, refrigerant mixture, or the like) from a relatively lower pressure gas (e.g., suction pressure) to a relatively higher-pressure gas (e.g., discharge pressure). In an embodiment, the compressor 10 can be a positive displacement compressor. For example, the compressor 10 can be a screw compressor, a scroll compressor, a reciprocating compressor, or the like.

The relatively higher-pressure gas discharged from the compressor 10 is also at a relatively higher temperature and flows from the compressor 10 through the working fluid line 22 to the condenser 14. The working fluid flows through the condenser 14 and rejects heat to a first process fluid (e.g., water, air, etc.). The cooled working fluid, which is now liquid or mostly liquid, flows to the expander 16 via the working fluid line 24. The expander 16 allows the working fluid to expand and reduces the pressure of the working fluid. In an embodiment, the expander may be an expansion valve, expansion plate, expansion vessel, orifice, or the like, or other such types of expansion mechanisms. It is to be appreciated that the expander may be any type of expander used in the field for expanding a working fluid to cause the working fluid to decrease in temperature. The gaseous/liquid working fluid has a lower temperature after being expanded by the expander 16.

This reduced pressure can be at an intermediate pressure that is higher than the suction pressure but lower than the discharge pressure of the compressor 10. As a result, the working fluid discharged from the expander 16 can be in a liquid form, a gaseous form, or a combination thereof. The working fluid discharged from the expander 16 flows via the working fluid line 26 to the evaporator 18 and absorbs heat from a second process fluid (e.g., water, air, etc.), heating the working fluid, and converts the working fluid to a gaseous or a mostly gaseous form. The gaseous working fluid then returns to the compressor 10 via the working fluid line 28. The above-described process continues while the climate control circuit is operating, for example, in a cooling mode (e.g., while the compressor 10 is enabled).

The climate control circuit can include a lubricant separator 12 disposed between the compressor 10 and the condenser 14. The lubricant separator 12 can be fluidly connected to a discharge of the compressor 10 via the working fluid line 20 and to an inlet of the condenser 14 via the working fluid line 22. The lubricant separator 12 is also fluidly connected to the compressor 10 to provide lubricant to various components of the compressor 10 (e.g., moving parts including bearings, etc.) via lubricant return line **30*a* and optionally via a second lubricant return line 30*b*. The lubricant separator 12 separates entrained lubricant from the working fluid compressed by the compressor 10. It will be appreciated that the number of lubricant return lines 30*a*, 30*b* can be selected based on, for example, which components of the compressor are being provided with lubricant. It is appreciated that the lubricant return line 30*a* and/or optionally the second lubricant return line 30*b* can return lubricant to various parts of the compressor or to a lubricant sump of the compressor and can be heated and/or cooled before being returned to the compressor 10. The lubricant separator 12, the lubricant return lines 30***a*, 30*b*, and lubricant sump can be a part of a lubricant circuit for supplying and storing lubricant for lubricating the moving parts of the compressor 10, as further discussed below.

Figure 2:
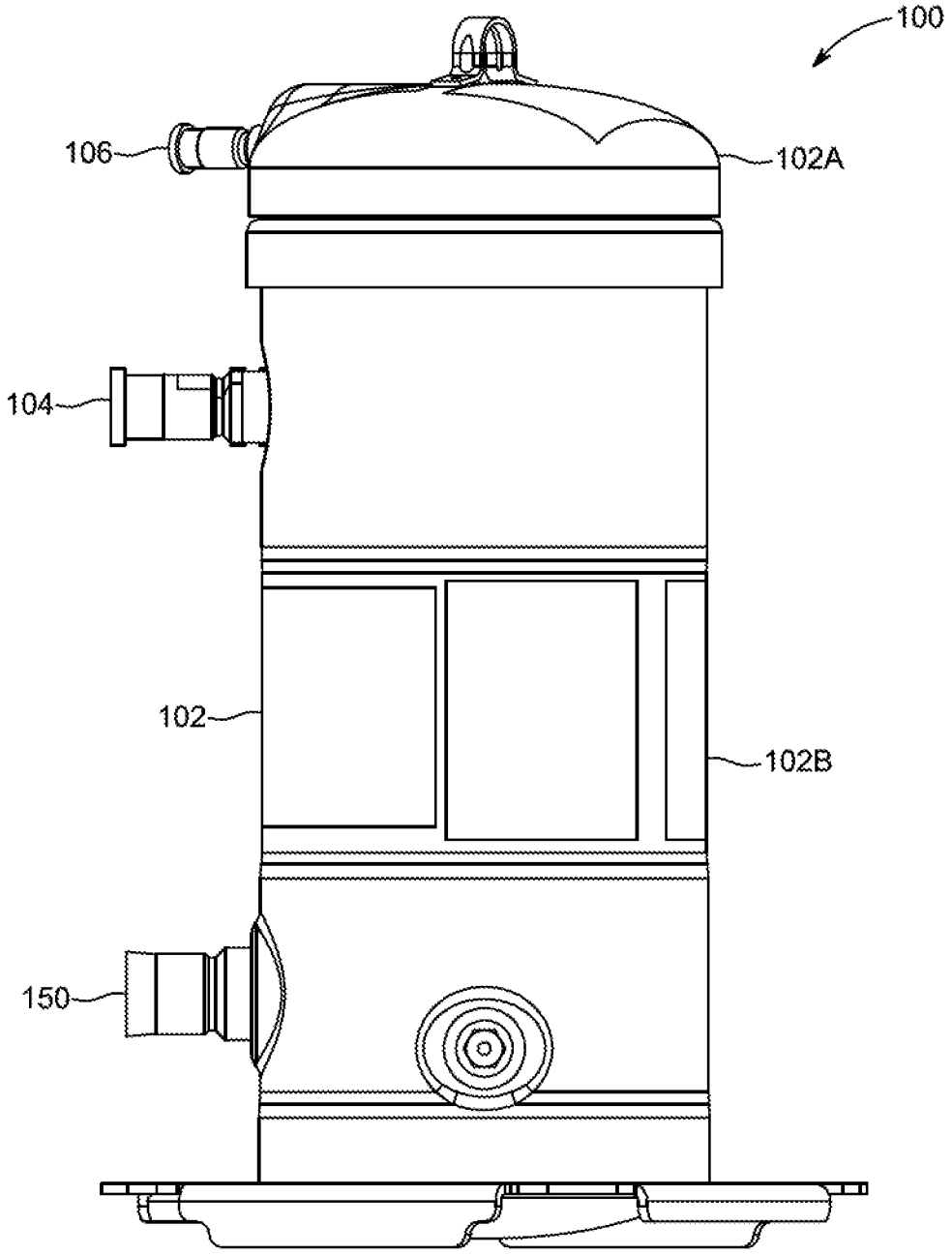
FIG. 2 is a side view of a compressor, according to an embodiment.

FIG. 2 is a side view of a compressor 100, according to an embodiment. In an embodiment, the compressor 100 can be the compressor 10 employed in the climate control circuit 1 of FIG. 1 for a transport climate control system used in a transport unit, including, but not limited to, a container (such as a container on a flat car, an intermodal container, etc.), a box car, a bus, truck, or other similar transport unit. It is to be appreciated that the compressor 100 can also be used for purposes other than in a climate control circuit. For example, the compressor 100 can be used to compress air, gases, other working fluids, or fluids other than a heat transfer fluid (e.g., natural gas, oxygen, etc.). It is to be appreciated that the compressor 100 can include additional features that are not described in detail in this specification. As shown in FIG. 2, the compressor 100 includes a compressor housing 102, a fluid inlet 104, a compressor outlet 106, and a lubricant inlet 150. The compressor housing 102 includes a lower portion 102B, and an upper portion 102A. The compressor housing 102 contains components of the compressor 100, such as scroll members, driving shaft, discharge pressure chamber, and the like.

Figure 3:
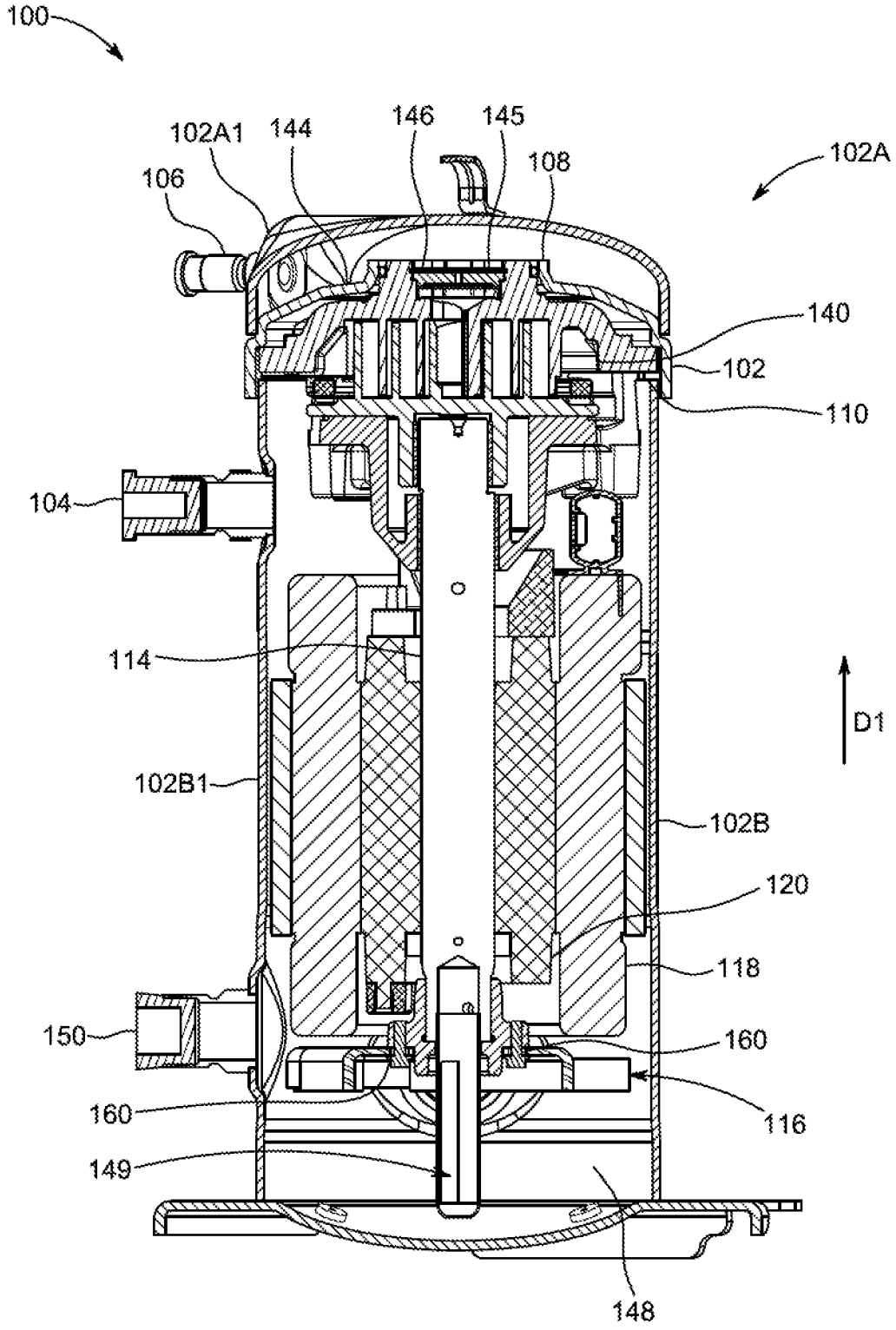
FIG. 3 is a sectional view of the compressor in FIG. 2, according to an embodiment.

FIG. 3 is an internal sectional view of the compressor 100 shown in FIG. 2, according to an embodiment. The illustrated compressor 100 is a single-stage vertical scroll compressor. It is to be appreciated that the principles described in this specification are not intended to be limited to single-stage scroll compressors and that they can be applied to multi-stage scroll compressors having two or more compression stages or other compressors that use lubrication for lubricating moving parts. Generally, the embodiments as disclosed in this specification are suitable for a compressor with a vertical or a near vertical crankshaft (e.g., crankshaft 114) in which lubricant availability and storage may be a limiting factor of the compressor. It is to be appreciated that the embodiments may also be applied to a horizontal compressor having a lubricant sump in the compressor housing. Also, while the compressor 100 is a scroll compressor, it will be appreciated that the embodiments described herein can also be used with a rotary compressor, a centrifugal compressor, a reciprocating compressor, or any other suitable type of compressor for compressing a working fluid.

The compressor outlet 106 connects a discharge pressure chamber 144 in the compressor 100 with conduits to discharge the relatively high pressure fluid from the compressor 100. In an embodiment, the compressor outlet 106 is disposed on a sidewall 102A1 of the upper portion 102A of the compressor housing 102 so that the relatively high pressure fluid from the compressor can be discharged from the side of the compressor 100. In certain applications where the space containing and servicing the compressor is limited, discharging from the side of the compressor 100 can be preferable.

The fluid inlet 104 connects a compression chamber of the compressor 100 with a conduit to receive a pressure fluid, such as receiving the pressure fluid directed through the working fluid line 28 in FIG. 1. In an embodiment, the fluid inlet 104 is disposed on a sidewall 102B1 of the compressor housing 102 so that the pressure fluid can be received from the side of the compressor 100. In certain applications where the space containing and servicing the compressor is limited, receiving fluid from the side of the compressor 100 can be preferable.

The fluid inlet 104 and the compressor outlet 106 are illustrated to be on the same sides of the compressor 100 in FIG. 3. It should be appreciated that in other embodiments the fluid inlet 104 and the compressor outlet 106 may be provided in a different relative location. For example, the fluid inlet 104 and the compressor outlet 106 in an embodiment may be provided on opposite sides of the compressor housing 102.

As shown in FIG. 3, the compressor 100 includes the driveshaft 114. The driveshaft 114 can alternatively be referred to as the crankshaft 114. The driveshaft 114 can be rotated by, for example, an electric motor 116. The electric motor 116 can include a stator 118 and a rotor 120. The driveshaft 114 is fixed to the rotor 120 such that the driveshaft 114 rotates along with the rotation of the rotor 120. The electric motor 116, stator 118, and rotor 120 operate according to generally known principles. The driveshaft 114 can, for example, be fixed to the rotor 120 via an interference fit or the like. The driveshaft 114 can, in an embodiment, be connected to an external electric motor, an internal combustion engine (e.g., a diesel engine or a gasoline engine), or the like. It will be appreciated that in such embodiments the electric motor 116, stator 118, and rotor 120 would not be present inside the compressor 100.

The compressor 100 can include the compressor housing 102 having the upper portion 102A, and the lower portion 102B. The upper portion 102A and the lower portion 102B of the compressor housing 102 are an outermost housing of the compressor 100. The upper portion 102A can include the compression chamber 140, the discharge pressure chamber 144, while the lower portion 102B provides the remainder of the compressor housing 102 for housing the compressor parts of the compressor 100. In an embodiment, any two or more of the lower portion 102B, the compression chamber 140, the discharge pressure chamber 144, or the upper portion 102A are stacked in an axial direction D1 of the compressor 100, e.g., vertically.

The compressor 100 includes a compression chamber 140 that includes an orbiting scroll member 108 and a non-orbiting scroll member 110. The non-orbiting scroll member 110 can alternatively be referred to as, for example, the non-orbiting scroll member, the stationary scroll, or the fixed scroll. The non-orbiting scroll member 110 is in meshing engagement with the orbiting scroll member 108. For example, scrolls of the non-orbiting scroll member 110 and the orbiting scroll member 108 can be aligned to intermesh using an Oldham coupling. The intermeshing of the non-orbiting scroll member 110 and the orbiting scroll member 108 compresses a fluid from a relatively low pressure, such as a suction pressure, to a relatively high pressure, such as a discharge pressure. For example, the compression chamber 140 includes the plurality of pockets formed by the intermeshed scrolls. Each pocket has a range of operable working fluid pressure less than a compressor discharge pressure at a compressor discharge. Operating according to the known principles for scroll compressors, the orbiting of the orbiting scroll moves and shrinks each pocket which compresses the fluid contained in each pocket.

In an embodiment, the compression chamber 140 discharges the fluid at the relatively high pressure from the center of the non-orbiting scroll member 110 as viewed from the top of the scroll compressor 100. The center of the non-orbiting scroll member 110 connects to a compression chamber discharge port 145. In an embodiment, a valve plate 146 can be disposed within the compression chamber discharge port 145. In an embodiment, the valve plate 146 is affixed to the non-orbiting scroll member 110 and has a pressure activated valve configured so that the fluid discharged from the compression chamber 140 to the discharge pressure chamber 144 is at least at a predetermined pressure. In an embodiment, the compression chamber discharge port 145 can have a tubular structure with an outer sidewall having a cylindrical surface. The compressor chamber discharge port 145 directs the compressed fluid discharged from the non-orbiting scroll member 110 to the discharge pressure chamber 144.

The discharge pressure chamber 144 is formed by a volume between the compression chamber 140 and the upper portion 102A. The discharge pressure chamber 144 fluidly connects the compression chamber discharge port 145 to the compressor outlet 106. The discharge pressure chamber 144 holds the fluid at the relatively high pressure discharged from the compression chamber 140 via the compression chamber discharge port 145 and provides the fluid to subsequent operations via the compressor outlet 106. For example, the subsequent operations can be a condenser.

In the illustrated embodiment, the compressor outlet 106 is positioned on the sidewall 102A1 of the upper portion 102A and oriented perpendicular to the driveshaft 114 of the compressor 100. In the illustrated embodiment, the compressor outlet 106 is therefore oriented such that fluid is discharged horizontally (with respect to the page). For example, the compressor outlet 106 extends from the compressor housing 102 in a direction perpendicular or about perpendicular to the axial direction D1 of the compressor 100. It is to be appreciated that the compressor outlet 106 can be angled in other embodiments. For example, the angle can be less than 60 degrees relative to the axial direction D1.

The compressor 100 includes the fluid inlet 104. The fluid inlet 104 is disposed on the sidewall 102B1 of the compressor housing 102. In the illustrated embodiment, the fluid inlet 104 is therefore oriented such that the pressure fluid is received horizontally (with respect to the page). It is to be appreciated that the fluid inlet 104 can be angled in other embodiments. For example, the angle can be less than 60 degrees relative to the axial direction D1. The fluid inlet 104 can also be arranged along various vertical directions of the compressor 100. For example, the fluid inlet 104 can be disposed at any height of the lower portion 102B of the compressor housing 102.

In an embodiment, the fluid inlet 104 and the compressor outlet 106 can be, for example, machined connections or tubes that are welded to the compressor housing 102. In an embodiment, any one or more of the compressor housing 102, the fluid inlet 104, and the compressor outlet 106 can be manufactured as a single piece.

In operation, the compressor 100 can receive a pressure fluid via the fluid inlet 104 and provide that fluid to the compression chamber 140, where the fluid is compressed and ultimately discharged via the compressor outlet 106. In an embodiment, the fluid can be a working fluid at a pressure lower than the discharge pressure and higher than the suction pressure, being in a liquid phase, a vapor phase, or a combination thereof.

The lower portion 102B of the compressor housing 102 can include a lubricant sump 148 for storing lubricant for lubricating the moving parts of the compressor 100. The crankshaft 114 includes an inner bore, for example, a pick up tube 149, in which one end of the crankshaft 114 is in fluid communication with the lubricant sump 148 such that rotation of the crankshaft 114 induces a pumping action for providing lubricant to the moving parts, e.g., scroll members, counter weights, or the like, and/or the bearings, e.g., upper bearings, thrust bearings, lower bearings, orbiting bearings, or the like, of the compressor 100. After the lubricant is provided to the moving parts, since at least the lower portion 102B is stacked in an axial direction D1 of the compressor 100, e.g., vertically, with at least one of the compression chamber 140, the discharge pressure chamber 144, or the upper portion 102A, the lubricant drains down the vertical scroll compressor to return to the lubricant sump 148 while providing lubrication and/or cooling to various parts of the compressor. It is also appreciated that in an embodiment, the crankshaft 114 is in fluid communication with a gear type oil pump that is in fluid communication with a lubricant sump that has the same or similar features.

In an embodiment, the compressor 100 is connected to a lubricant separator 12. The lubricant separator 12 separates the lubricant from the compressed fluid discharged from the compressor 100, in which the lubricant can be returned to the lubricant sump 148 via piping. Before the lubricant from the lubricant separator 12 is returned, the lubricant can be processed, for example, filtered, cooled, heated to remove working fluid, remove condensation, or the like, before being returned to the lubricant sump 148.

In an embodiment, the lubricant sump 148 is connected to an auxiliary sump 152 via the lubricant inlet 150 so that the auxiliary sump 152 is in fluid communication with the lubricant sump 148. The auxiliary sump 152 is provided such that the lubricant is able to flow by gravity between the lubricant sump and the auxiliary sump. Thus, the auxiliary sump 152 provides a buffering storage capacity of lubricant so that an auxiliary amount of lubricant is available during the operation of the scroll compressor 100. For example, in the case of the prior designs of the scroll compressor, if the scroll compressor is operated at high speeds to decrease the temperature (as opposed to normal operations to maintain temperature) of a container of a transport unit quickly, e.g., after start-up or open door events, the lubricant in the lubricant sump of the compressor can be emptied due to the fast pumping action of the lubricant to the moving parts and the time delay for the lubricant to drain down the compressor, until an equilibrium of the lubricant flow is established. In an embodiment, however, by having the auxiliary sump 152, a buffering amount of lubricant is provided so that when the lubricant in the lubricant sump is used/pumped, lubricant is able to flow between the auxiliary sump 152 and the lubricant sump 148 as the level of the lubricant in the lubricant sump 148 decreases. The flow of lubricant between the auxiliary sump 152 and the lubricant sump 148 is provided by gravity, in which the flow of lubricant between the auxiliary sump 152 and lubricant sump 148 is dependent on the height of the level of lubricant in the auxiliary sump 152 and the lubricant sump 148. Such a structure and arrangement also allows excess lubricant provided in the lubricant sump 148, e.g., due to the lubricant draining down the compressor reaching the lubricant sump and/or excess entrainment of the working fluid in the lubricant or the like, to flow from the lubricant sump 148 to the auxiliary sump 152 to avoid a high level in the lubricant sump 148, to avoid a high level in the lubricant sump, which is set to be lower than the lowest part of the drive shaft, e.g., the lower counter weights 160, to not adversely affect the compressor efficiency and/or performance. s In an embodiment, the auxiliary sump 152 is provided externally of the compressor housing 102. It is appreciated that by providing the auxiliary sump 152 externally of the compressor housing 102, the auxiliary sump 152 can be provided at various locations of the engine of a transport unit to maintain existing footprint designs of the climate control circuit, transport climate control system, the engine, or the like, as long the auxiliary sump is positioned at a height to allow lubricant to flow by gravity between the lubricant sump and the auxiliary sump, and vice versa. It is also appreciated that the auxiliary sump 152 can be placed at various locations of the engine depending on the heating and/or cooling needs of the lubricant in the auxiliary sump 152. For example, if the lubricant requires heating to maintain a certain viscosity or to remove any absorbed working fluid, the auxiliary sump 152 can be placed near the combustion chamber of a diesel engine, exhaust, oil pan, or the like. It is also appreciated that by providing the auxiliary sump externally of the compressor, the design of the compressor housing, existing footprint of the climate control circuit and/or the engine, or the like may not have to be significantly modified to incorporate the auxiliary sump. Such design may also allow modifications of the auxiliary sump, for example, to include a heater inside the auxiliary sump, since the auxiliary sump is a stand-alone device.

In an embodiment, the auxiliary sump 152 can include a plurality of auxiliary tanks, in which each of the auxiliary tanks are provided separately in the existing footprint design of the climate control circuit, transport climate control system, the engine of the like, e.g., at different or the same locations in the engine. In an embodiment, the auxiliary sump 152 and/or at least one of the auxiliary tanks has dimensions in which a large volume change can occur with a small change in height, e.g., the auxiliary sump has a diameter or length that is greater than the height. Thus, by having such ratio, the auxiliary sump is able to provide a large volume of lubricant with a small change in height. For example, in an embodiment, the auxiliary sump and/or the auxiliary tank can be designed as a long tube to fit existing designs of the engine and/or transport climate control system, while providing a large buffering capacity of the lubricant with small changes in height in the lubricant sump, as further discussed below.

In an embodiment, the auxiliary sump 152 is a "dead-end" system, in which the auxiliary sump 152 is only in fluid communication with the lubricant sump(s) of a compressor(s). That is, the auxiliary sump 152 is not connected to any of the other processes of the climate control cycle, e.g., condenser, expander, evaporator, lubricant separator, or the like, or other engine part or component, but is arranged so that lubricant only flows by gravity between the lubricant sump and the auxiliary sump. Thus, the lubricant in the auxiliary sump 152 avoids the need for further processing of the lubricant while having little to low amounts of the working fluid absorbed into the lubricant. It is also appreciated that by providing the auxiliary sump 152 as a "dead-end" system, the auxiliary sump 152 can be used in a hermetically-sealed system, e.g., an air tight or semi-air tight system, since the auxiliary sump 152 is only connected to the lubricant inlet 150 of the lubricant sump 148 and it would be easy to maintain sealing of the same, e.g., welding of the piping connecting the lubricant inlet to the auxiliary sump 152 or the like.

Figure 4:
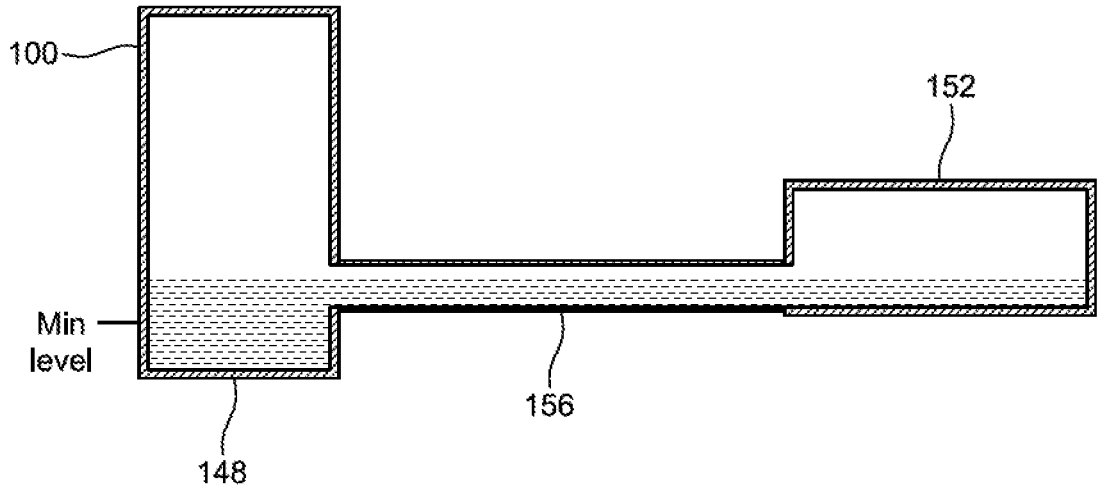
FIG. 4 is a schematic diagram for a lubricant circuit and auxiliary sump, according to an embodiment.

An embodiment of the connection of the auxiliary sump 152 is shown in FIG. 4. The auxiliary sump 152 is in fluid communication with the lubricant sump 148 of the compressor 100 to provide additional (e.g., buffering amount) lubricant to the lubricant sump 148 to avoid the lubricant sump 148 from reaching a predetermined level. For example, in an embodiment, the auxiliary sump 152 is connected to the lubricant sump 148 via a first pipe 156 of a lubricant circuit, in which the auxiliary sump 152 includes a bottom plate 154 that is provided at a vertical height, relative to the transport unit, that is at least equal to a height at the predetermined level in the lubricant sump 148. The first pipe 156 has a diameter that allows a two-phase flow in the pipe so that the vapor space of the auxiliary sump 152 is connected with the vapor space of the compressor above the lubricant level in the lubricant sump 148. A height of the first pipe 156 is defined by at least the height of the maximum height of the lubricant sump 148 that is set to be lower than the lowest part of the drive shaft to avoid the lubricant contacting a moving part of the compressor, which can affect the efficiency and/or performance of the compressor. Thus, when the lubricant level in the lubricant sump 148 is lower than the height of the lubricant level in the auxiliary sump 152, the lubricant from the auxiliary sump 152 flows by gravity to the lubricant sump 148. In an embodiment, the predetermined level is at least the minimum level of lubricant needed for the adequate supply of lubricant to the scroll compressor during normal operations of the scroll compressor, e.g., equilibrium level of lubricant, e.g., based on the lubricant entrained in the compressed fluid and/or drained from the compressor parts and returned to the lubricant sump of the compressor.

It is appreciated that by having the bottom plate of the auxiliary sump 152 above the predetermined level, the auxiliary sump 152 can provide lubricant during different buffer conditions and fully utilize the amount of lubricant stored in the auxiliary sump. For example, when the compressor 100 is run at a high speed resulting in more of the lubricant in the lubricant sump 148 being pumped to the moving parts and entrained in the compressed fluid and loss of lubricant level in the lubricant sump, the lubricant from the auxiliary sump 152 flows by gravity to maintain lubricant level in the lubricant sump for the adequate lubrication of the compressor components. Additionally, when a surplus supply of lubricant is provided in the lubricant sump 148, for example, during slow speed conditions, in which the return of the lubricant to the compressor and draining of the lubricant down the compressor is greater than entrainment of the lubricant, the auxiliary sump 152 is provided so that the lubricant can flow out of the lubricant sump 148 to the auxiliary sump 152. Thus, high level conditions in the lubricant sump 148 can be avoided, in which the high level condition of the lubricant in the compressor would adversely affect the compressor performance, e.g., impacts compressor efficiency, energy drain and more power usage, oil carry-over, foam, disruption, or the like. It is also appreciated that the availability of the auxiliary sump 152 can provide lubricant during movement of the transport unit that may affect the lubricant level in the lubricant sump 148. For example, when the transport unit is a trailer truck and is going uphill, the auxiliary sump 152 aids in buffering the availability of lubricant by transferring lubricant to the lubricant sump or vice versa if the level of the lubricant in the lubricant sump is greater than the high level condition. That is, the auxiliary sump 152 provides additional auxiliary storage capabilities for different transitioning states, e.g., different operating conditions/modes, of the compressor 100 and transport unit.

Figure 5:
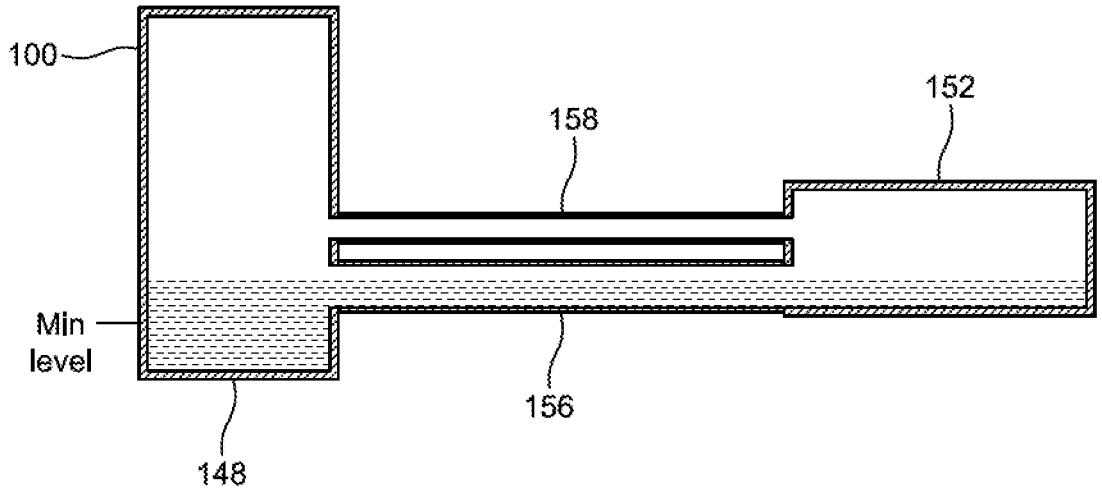
FIG. 5 is a schematic diagram for a lubricant circuit and auxiliary sump, according to another embodiment.

FIG. 5 shows another embodiment of the connection of the auxiliary sump 152. The auxiliary sump 152 is fluidly connected to the lubricant sump 148 via a first pipe 156 and a second pipe 158 of a lubricant circuit, in which the auxiliary sump 152 includes a bottom plate that is provided at a vertical height, relative to the transport unit, that is at least equal to a height at the predetermined level in the lubricant sump 148. The first pipe 154 is connected to the bottom of the auxiliary sump 152 and to the lubricant sump 148 above the predetermined level so that the first pipe 154 is in fluid communication with the lubricant in the auxiliary sump 152 and the lubricant sump 148. In an embodiment, it is preferred that the first pipe 154 has a diameter in which the first pipe 154 only includes one phase of the lubricant to allow the fluid communication between the lubricant sump 148 and the auxiliary sump 152. The second pipe 158 is provided for connecting the vapor space of the auxiliary sump 152 and the lubricant sump 148. For example, the second pipe 158 is connected to the auxiliary sump 152 above the lubricant level in the auxiliary sump 152 and above the maximum height of the lubricant in the lubricant sump 148, e.g., lower than the lowest part of the drive shaft, for example, the lower counter weights. Thus, when the lubricant level in the lubricant sump 148 is lower than the height of the lubricant level in the auxiliary sump 152, the lubricant from the auxiliary sump 152 flows by gravity to the lubricant sump 148. In an embodiment, the predetermined level is at least the minimum level of lubricant needed for the adequate supply of lubricant to the scroll compressor during normal operations of the scroll compressor, e.g., equilibrium level of lubricant, e.g., based on the lubricant entrained in the compressed fluid and/or drained from the compressor parts and returned to the lubricant sump of the compressor. It is appreciated that while FIG. 5 shows the second pipe 158 being connected horizontally to the auxiliary sump 152, the second pipe 158 can be connected to the top surface of the auxiliary sump 152 depending on the space available in the footprint to allow the most utilization of the auxiliary storage capability of the auxiliary tank 152.

While the above description has been discussed with respect to a scroll compressor, it will be understood that the structure can be used for any compressor system that uses lubrication to lubricate the moving parts of the compressor in which space can be a limiting factor in the design of the system. For example, in an embodiment, the auxiliary sump can be used for a vertical scroll compressor, in which the vertical scroll compressor includes a lubricant sump and the auxiliary sump is in fluid communication with the lubricant sump. That is, it is appreciated that the auxiliary sump can be used for a number of different applications, in which the compressor may not have an adequate capacity of lubricant to maintain lubrication of the moving parts, and may need a buffering capacity of lubricant provided by the auxiliary sump.

Figure 6:
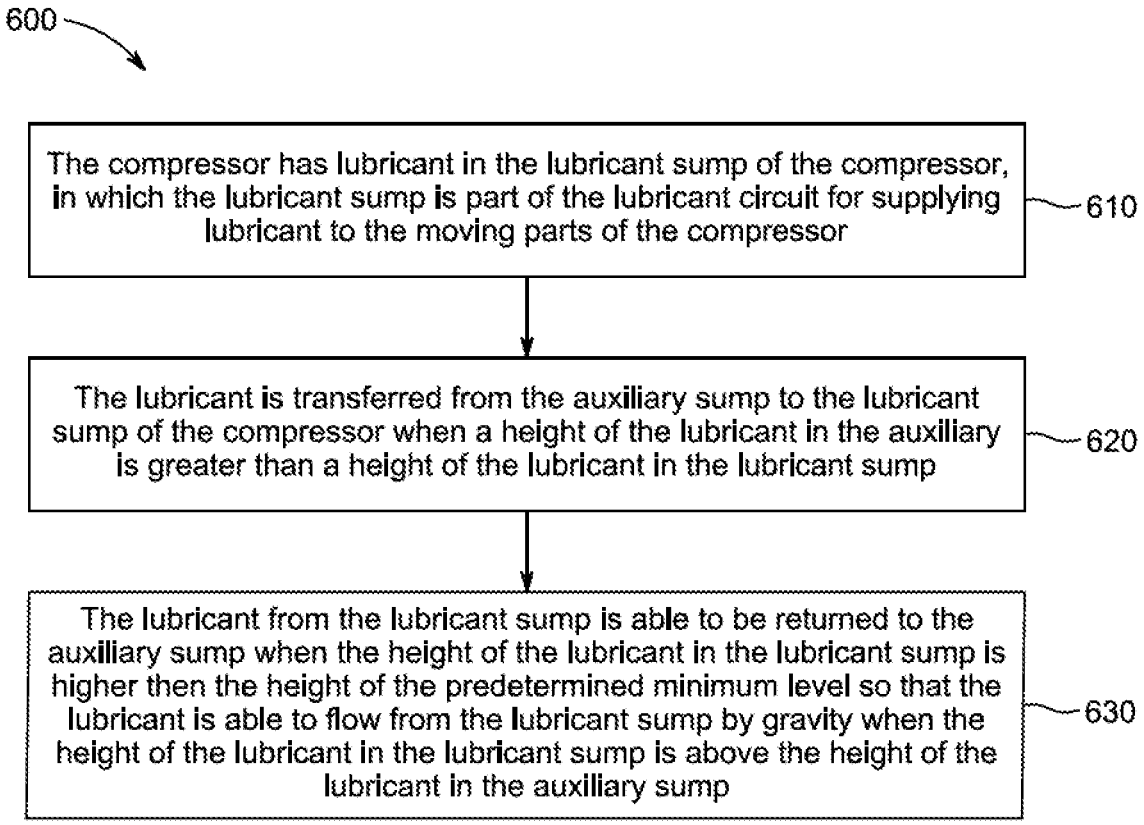
FIG. 6 is a flow chart for a method for providing lubrication, according to an embodiment.

FIG. 6 is a flowchart of a method 600 for maintaining lubrication supply for a compressor of a transport climate control system, according to an embodiment. The transport climate control system includes a compressor having a compressor housing, a compressor element provided in the compressor housing for compressing a working fluid, and a lubricant circuit, in which the lubricant circuit includes a lubricant sump provided in the compressor housing for storing a lubricant; and an auxiliary sump in fluid communication with the lubricant sump. In an embodiment, the method 600 may be employed by the compressor 100 in the climate control circuit 1. The method 600 starts at 610.

At 610, the compressor 100 has lubricant in the lubricant sump of the compressor, in which the lubricant sump is part of the lubricant circuit for supplying lubricant to the moving parts of the compressor. The auxiliary sump that is in fluid communication with the lubricant sump is provided in the transport climate control system. The compressor 100 can then be started or can have a change in operational conditions, e.g., low speed to high speed. The method 600 then proceeds to 620.

At 620, lubricant is transferred from the auxiliary sump to the lubricant sump of the compressor when a height of the lubricant in the auxiliary sump is greater than a height of the lubricant in the lubricant sump. In an embodiment, the auxiliary sump includes a bottom plate. The bottom plate is provided at a vertical height, relative to a transport unit, that is at least equal to a height of a predetermined minimum level in the lubricant sump so that lubricant is able to flow from the auxiliary sump by gravity when the lubricant level in the lubricant sump is below the predetermined minimum level. The predetermined minimum level is at least the minimum level of lubricant in the lubricant sump that is needed for maintaining the adequate supply of lubricant to the moving parts of the scroll compressor during normal operations of the scroll compressor, e.g., equilibrium level of lubricant, e.g., based on the lubricant entrained in the compressed fluid and/or drained from the compressor parts and returned to the lubricant sump of the compressor.

For example, in an embodiment, when the compressor speed is changed from low speed to high speed, the centrifugal action of the drive shaft induces a pumping action in the lubricant sump to pump the lubricant to the moving parts of the compressor. At least because of the high pumping speed, e.g., high volume, of the lubricant that is pumped to the top of the compressor and the length of elapsed time as the lubricant drains down the compressor, e.g., after overcoming gravitational forces and surface tension of the moving parts, the volume of the lubricant decreases in the lubricant sump. As the level of the lubricant decreases in the lubricant sump, the lubricant in the auxiliary sump is transferred from the auxiliary sump to the lubricant sump. The auxiliary sump is able transfer the lubricant until the level of lubricant in the auxiliary sump reaches the bottom plate. The method 600 then proceeds to 630.

At 630, the lubricant from the lubricant sump is able to be returned to the auxiliary sump when the height of the lubricant in the lubricant sump is higher than the height of the predetermined minimum level so that lubricant is able to flow from the lubricant sump by gravity when the height of the lubricant in the lubricant sump is above the height of the lubricant in the auxiliary sump. Thus, the auxiliary sump is a lubricant buffer system for the lubricant circuit by storing excess lubricant outside the compressor housing.

Figure 7:
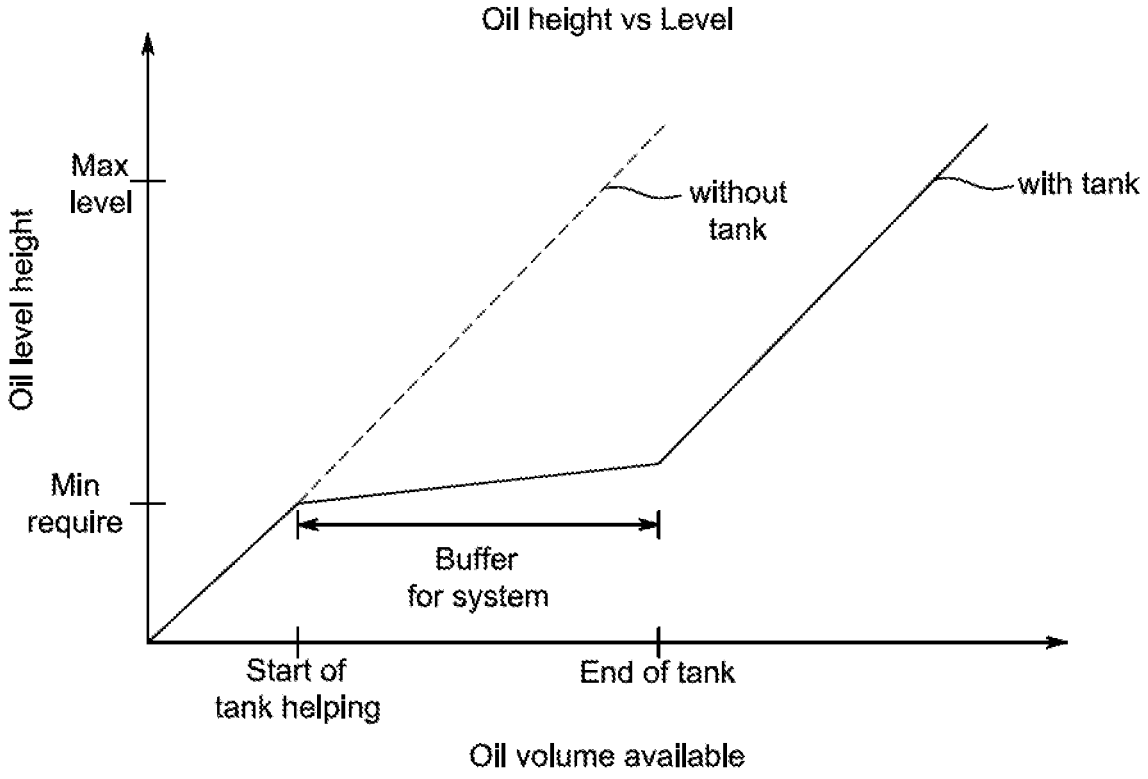
FIG. 7 is a graph showing the level in the lubricant sump supported by the auxiliary sump, according to an embodiment.

As shown in FIG. 7, the auxiliary sump acts as a buffer system for the lubricant in the lubricant sump of the compressor. After the lubricant in the lubricant sump 148 is above the minimum level necessary for maintaining lubrication of the moving parts of the compressor, the lubricant is returned to the auxiliary sump. For example, as the lubricant draining down the compressor reaches the lubricant sump, the level of the lubricant in the lubricant sump increases. When the level of the lubricant in the lubricant sump is above the predetermined minimum level and has a height greater than the height of the lubricant in the auxiliary sump, the lubricant from the lubricant sump is transferred (or returned) to the auxiliary sump. The auxiliary sump can have a large volume to height ratio, e.g., a much greater length or diameter than height, so that the lubricant level in the lubricant sump of the compressor can have a small change in height for a high volume storage of the lubricant in the auxiliary sump. Once the auxiliary sump reaches a maximum level, e.g., is full, the availability of the auxiliary sump as a buffer ends, and the compressor will then be filled with any additional volume of the lubricant.

It is appreciated that in the embodiments, the lubricant in the auxiliary sump and lubricant sump are equalized by gravity. Thus, capital investment for manufacturing or retrofitting the auxiliary sump design is minimized, since the flow of lubricant is mainly dependent on gravity, e.g., height of the lubricant. Such auxiliary sump design also allows the placement of the auxiliary sump anywhere in the engine of a transport unit (and/or transport climate control system) that allows the flow of lubricant from the auxiliary sump to the lubricant sump, and vice versa, while maintaining the footprint of existing compressor designs and engine and/or transport climate control system layouts and/or selective modifications of compressors in multi temp systems and single temp systems, in which additional lubricant storage is necessary for only selected compressors.

ASPECTS

It is noted that any of aspects 1-12, 13-17, and 18 can be combined.

Aspect 1. A climate control system comprising: a compressor, the compressor comprising: a compressor housing; a compressor element provided in the compressor housing for compressing a working fluid; a lubricant circuit, wherein the lubricant circuit comprises a lubricant sump provided in the compressor housing for storing a lubricant, wherein the lubricant is provided for lubricating moving parts of the compressor; and an auxiliary sump in fluid communication with the lubricant sump, wherein the auxiliary sump is configured such that the lubricant flows by gravity between the auxiliary sump and the lubricant sump.

Aspect 2. The climate control system according to aspect 1, wherein the auxiliary sump comprises a plurality of auxiliary tanks.

Aspect 3. The climate control system of any one of aspects 1-2, wherein the auxiliary sump is provided externally of the compressor housing.

Aspect 4. The climate control system of any one of aspects 1-3, wherein the auxiliary sump includes a diameter or length that is greater than a height of the auxiliary sump.

Aspect 5. The climate control system of any one of aspects 1-4, wherein the auxiliary sump is only in fluid communication with the lubricant sump of the compressor.

Aspect 6. The climate control system of any one of aspects 1-5, wherein the auxiliary sump includes a bottom plate, wherein the bottom plate is provided at a vertical height that is at least equal to a height of a predetermined level in the lubricant sump.

Aspect 7. The climate control system according to aspect 6, wherein the lubricant circuit comprises a first pipe connected at least to the bottom of the auxiliary sump and to the lubricant sump at the predetermined level.

Aspect 8. The climate control system according to aspect 7, wherein the lubricant circuit further comprises a second pipe connected to a vapor space in the auxiliary sump and above a fluid level of the lubricant sump.

Aspect 9. The climate control system according to aspect 8, wherein the second pipe is provided at a maximum level of lubricant in the lubricant sump.

Aspect 10. The climate control system according to aspect 6, wherein the lubricant circuit comprises a pipe connected to the bottom of the auxiliary sump and to the lubricant sump at the predetermined level, wherein the pipe has a diameter in which the lubricant is provided in the pipe at a height equal to a height of the lubricant in the auxiliary sump so that a vapor space is provided in the pipe that is connected to a vapor space in the auxiliary sump and a vapor space in the lubricant sump.

Aspect 11. The climate control system according to aspect 6, wherein the predetermined level of the lubricant sump is a minimum level of lubricant required for lubricating the moving parts of the compressor.

Aspect 12. The climate control system of any one of aspects 1-11, wherein the compressor is a scroll compressor and the lubricant sump is provided vertically below the compressor element of the scroll compressor.

Aspect 13. A lubricant circuit for a compressor of a climate control system, comprising a lubricant sump provided in a compressor housing for storing a lubricant, wherein the lubricant is provided for lubricating moving parts of the compressor, and an auxiliary sump in fluid communication with the lubricant sump, wherein the auxiliary sump is configured in a way such that the lubricant flows by gravity between the lubricant sump and the auxiliary sump.

Aspect 14. The lubricant circuit according to aspect 13, wherein the auxiliary sump includes a bottom plate, wherein the bottom plate is provided at a vertical height that is at least equal to a height of a predetermined level in the lubricant sump.

Aspect 15. The lubricant circuit according to aspect 14, wherein the lubricant circuit comprises a first pipe connected at least to the bottom of the auxiliary sump and to the lubricant sump at the predetermined level.

Aspect 16. The lubricant circuit according to aspect 15, wherein the lubricant circuit comprises a second pipe connected to a vapor space in the auxiliary sump and above a fluid level of the lubricant sump.

Aspect 17. The lubricant circuit according to aspect 15, wherein the pipe has a diameter in which the lubricant is provided in the pipe at a height equal to a height of the lubricant in the auxiliary sump so that a vapor space is provided in the pipe that is connected to a vapor space in the auxiliary sump and a vapor space in the lubricant sump.

Aspect 18. A method for maintaining lubrication supply for a compressor of a climate control system, the climate control system comprising a compressor comprising a compressor housing, a compressor element provided in the compressor housing for compressing a working fluid, and a lubricant circuit, wherein the lubricant circuit comprises a lubricant sump provided in the compressor housing for storing a lubricant; and an auxiliary sump in fluid communication with the lubricant sump, the method comprising transferring lubricant from the auxiliary sump to the lubricant sump of the compressor when a height of the lubricant in the auxiliary sump is greater than a height of the lubricant in the lubricant sump, and returning the lubricant from the lubricant sump to the auxiliary sump when the height of the lubricant in the lubricant sump is higher than a height of a predetermined minimum level in the lubricant sump, wherein the lubricant in the auxiliary sump and lubricant sump are equalized by gravity.

The terminology used in this specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A climate control system comprising:

a compressor, the compressor comprising:

a compressor housing;

a compressor element provided in the compressor housing for compressing a working fluid;

a lubricant circuit, wherein the lubricant circuit comprises a lubricant sump provided in the compressor housing for storing a lubricant, wherein the lubricant is provided for lubricating moving parts of the compressor; and an auxiliary sump in fluid communication with the lubricant sump, wherein the auxiliary sump is configured such that the lubricant flows by gravity between the auxiliary sump and the lubricant sump, wherein the auxiliary sump is provided externally of the compressor housing and is in fluid communication with the lubricant sump via a pipe, wherein the auxiliary sump includes a bottom plate, wherein the bottom plate is provided at a vertical height that is at least equal to a height of a predetermined level in the lubricant sump, and wherein the predetermined level of the lubricant sump is a minimum level of lubricant necessary for lubricating the moving parts of the compressor.

2. The climate control system according to claim 1, wherein the auxiliary sump comprises a plurality of auxiliary tanks.

3. The climate control system according to claim 1, wherein the auxiliary sump includes a diameter or length that is greater than a height of the auxiliary sump.

4. The climate control system according to claim 1, wherein the auxiliary sump is only in fluid communication with the lubricant sump of the compressor.

5. The climate control system according to claim 1, wherein the pipe is connected at least to the bottom of the auxiliary sump and to the lubricant sump at the predetermined level.

6. The climate control system according to claim 5, wherein the lubricant circuit further comprises a second pipe connected to a vapor space in the auxiliary sump and above a fluid level of the lubricant sump.

7. The climate control system according to claim 6, wherein the second pipe is provided at a maximum level of lubricant in the lubricant sump.

8. The climate control system according to claim 1, wherein the pipe is connected to the bottom plate of the auxiliary sump and to the lubricant sump at the predetermined level, wherein the pipe has a diameter in which the lubricant is provided in the pipe at a height equal to a height of the lubricant in the auxiliary sump so that a vapor space is provided in the pipe that is connected to a vapor space in the auxiliary sump and a vapor space in the lubricant sump.

9. The climate control system according to claim 1, wherein the compressor is a scroll compressor and the lubricant sump is provided vertically below the compressor element of the scroll compressor.

10. A lubricant circuit for a compressor of a climate control system, comprising:

a lubricant sump provided in a compressor housing for storing a lubricant, wherein the lubricant is provided for lubricating moving parts of the compressor, and an auxiliary sump in fluid communication with the lubricant sump, wherein the auxiliary sump is configured in a way such that the lubricant flows by gravity between the auxiliary sump and the lubricant sump, wherein the auxiliary sump is provided externally of the compressor housing and is in fluid communication with the lubricant sump via a pipe, wherein the auxiliary sump includes a bottom plate, wherein the bottom plate is provided at a vertical height that is at least equal to a height of a predetermined level in the lubricant sump, and wherein the predetermined level of the lubricant sump is a minimum level of lubricant necessary for lubricating the moving parts of the compressor.

11. The lubricant circuit according to claim 10, wherein the pipe is connected at least to the bottom plate of the auxiliary sump and to the lubricant sump at the predetermined level.

12. The lubricant circuit according to claim 11, wherein the lubricant circuit comprises a second pipe connected to a vapor space in the auxiliary sump and above a fluid level of the lubricant sump.

13. The lubricant circuit according to claim 11, wherein the pipe has a diameter in which the lubricant is provided in the pipe at a height equal to a height of the lubricant in the auxiliary sump so that a vapor space is provided in the pipe that is connected to a vapor space in the auxiliary sump and a vapor space in the lubricant sump.

14. A method for maintaining lubrication supply for a compressor of a climate control system, the climate control system comprising a compressor comprising a compressor housing, a compressor element provided in the compressor housing for compressing a working fluid, and a lubricant circuit, wherein the lubricant circuit comprises a lubricant sump provided in the compressor housing for storing a lubricant; and an auxiliary sump in fluid communication with the lubricant sump, the method comprising:

transferring lubricant, via a pipe, from the auxiliary sump to the lubricant sump of the compressor when a height of the lubricant in the auxiliary sump is greater than a height of the lubricant in the lubricant sump, wherein the auxiliary sump is provided externally of the compressor housing and a bottom plate of the auxiliary sump is provided at a vertical height that is at least equal to a height of a predetermined level in the lubricant sump, and returning the lubricant from the lubricant sump to the auxiliary sump, via the pipe, when the height of the lubricant in the lubricant sump is higher than the height of the predetermined level in the lubricant sump, wherein the predetermined level of the lubricant sump is a minimum level of lubricant necessary for lubricating moving parts of the compressor, wherein the lubricant in the auxiliary sump and lubricant sump are equalized by gravity.

* * * * *